United States Patent [19]

Szabo

[11] Patent Number: 5,058,890

[45] Date of Patent: Oct. 22, 1991

[54] POWERSWING BAT SPEED ENHANCER

[76] Inventor: Gerald S. Szabo, 806 Broadfield Dr., Newark, Del. 19713

[21] Appl. No.: 560,793

[22] Filed: Jul. 30, 1990

[51] Int. Cl.[5] ..... A63B 69/00

[52] U.S. Cl. ..... 273/26 R

[58] Field of Search ..... 273/26 R, 72 R, 26 B, 273/29 R, 29 A, 67 DC

[56] References Cited

U.S. PATENT DOCUMENTS

| | | | |
|---|---|---|---|
| 3,463,492 | 8/1969 | White | 273/26 B |
| 3,833,217 | 9/1974 | Greaney | 273/26 B |
| 4,416,451 | 11/1983 | Solloway | 273/26 B |
| 4,907,800 | 3/1990 | Passamaneck | 273/26 B |

*Primary Examiner*—Theatrice Brown

[57] ABSTRACT

The instant invention relates to a bat swing speed and power enhanced comprised of a cylindrical member having two sets of a plurality of spaced apart wing elements extending from its surface in a pattern about the longitudinal axis of the cylindrical member. The wings of each set are attached to the cylindrical member at an angle relative to the longitudinal axis of the cylindrical member and being equally spaced about the longitudinal axis of the member. With this arrangement, it is found that a constant air resistance force will be exerted against the bat during the entire course of a normal swing motion.

2 Claims, 3 Drawing Sheets

POWERSWING BAT SPEED ENHANCER

BACKGROUND OF THE INVENTION

1. Technical Field

This invention relates to an improved attachment for a baseball and/or softball bat which provides a substantially constant resistance to a bat during the entire normal swinging motion of a bat by a player. It has been found that prolonged practice swinging of the instant invention when attached to a bat will enhance a batters swing speed as well as his ball hitting power.

2. SUMMARY OF THE INVENTION

Bat speed and power are two of the most important factors in being successful in the sports of baseball and softball. The instant apparatus allows for constant air resistance throughout the full range of motion of a typical bat swing. The device has double curved turbine-like wings which present a constant surface area for constant air resistance throughout the swing. This constant air resistance produces steady pressure against power supplied by a batter. Unlike prior art devices, the instant invention eradicates fluctuations in air resistance to a bat during the swing motion.

Briefly the power swing enhancer invention is directed at a device which comprises a unit of a cylinder to which two set of four bent and contoured wings are attached with one set contoured clockwise and the other set contoured counterclockwise and set in a fashion so that from the top of one wing to the bottom of its wing set a radiant angle of 45 degrees is cover with two counter facing and balanced surfaces. The bend and contour of the wing surfaces are set in this fashion so as to keep constant the available surface area for air resistance thru the complete motion of a normal batters swing.

DESCRIPTION OF THE PREFERRED EMBODIMENT

Figure 1:
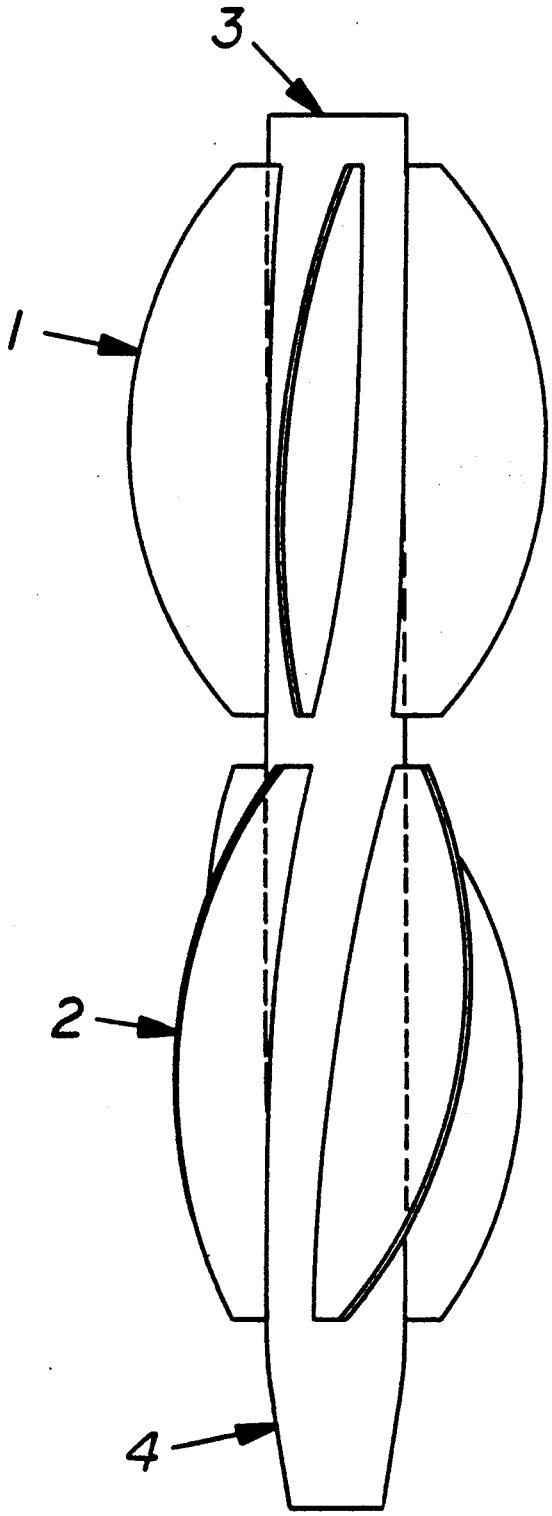
FIG. 1 is an elevation view of the device standing on end.

Referring to FIG. 1, the swing enhancer has an elongated cylindrical sleeve member 3. Cylindrical sleeve member 3 has an internal diameter slightly larger than the diameter of the hitting end of a standard baseball and/or softball bat and a length to extend substantially the active length of the ball contact barrel portion of a bat. One end 4 of the cylindrical member 3 has a conical shaped taper whereby when the device is fitted over the handle of a bat the conical shaped end 4 will engaged the tapered portion of a bat to thereby secure the device on the bat for swinging therewith.

Figure 2:
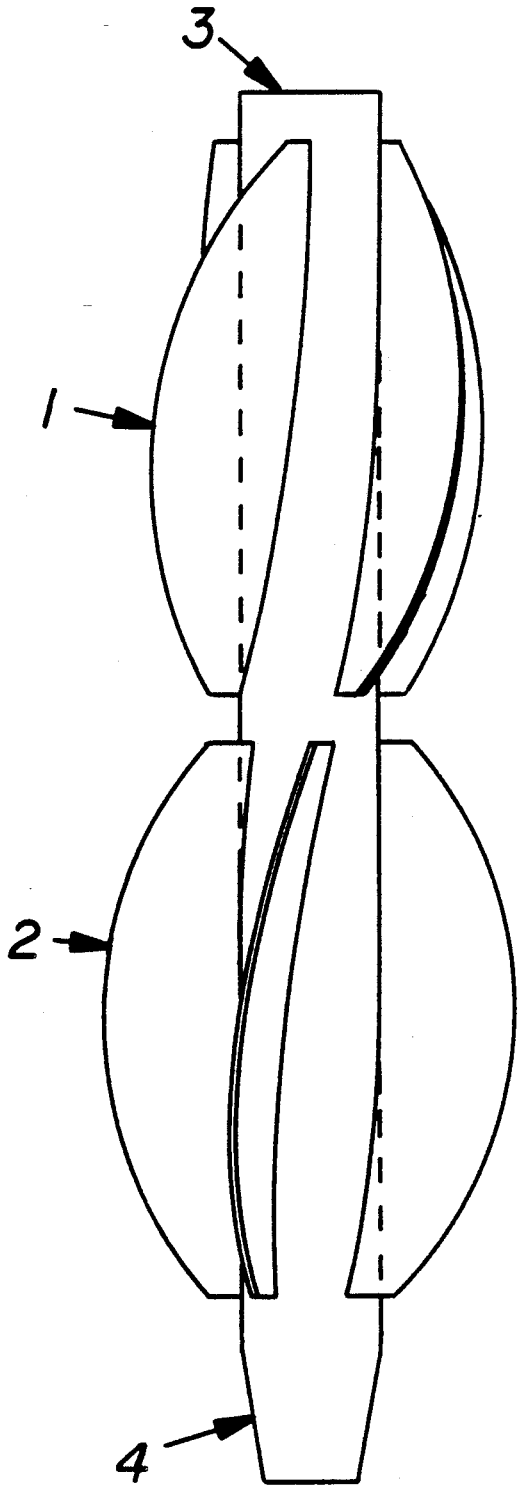
FIG. 2 is FIG. 1 rotated 45 degrees.
Figure 3:
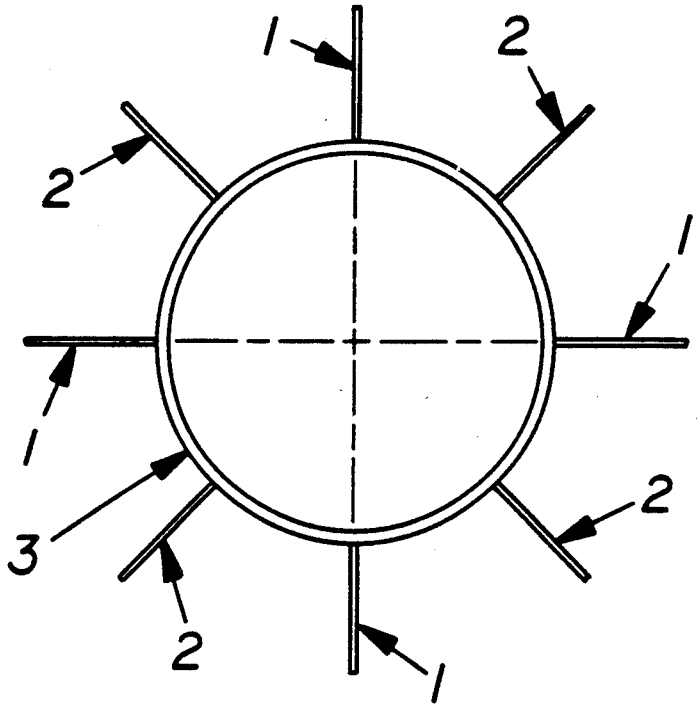
FIG. 3 is a top view of the device less wing contour lines.
Figure 4:
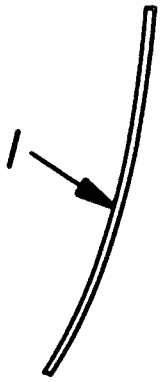
FIG. 4 is an edge contour view of the upper fin type.
Figure 5:
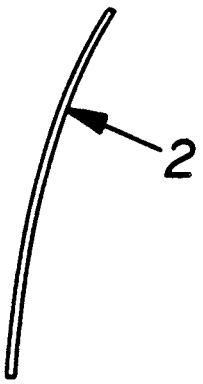
FIG. 5 is an edge contour view of the lower fin type.

Mounted on the outer surface of the cylindrical member are two sets of winged members 1 and 2. Each winged member set has four wings spaced at equal intervals about the longitudinal axis of the cylindrical member. Each of the wings has a length greater than its width and has planar configuration before being mounted upon the outer surface of the cylindrical member. One of the longitudinal edges of each wing has a curved configuration and the opposite longitudinal edge has a straight or planar configuration. The longitudinal edge of each wing of each set is attached to the cylindrical sleeve member to extend therealong at an angle relative to the longitudinal axis of the sleeve member. While the wings can be set at various angles, it has been found that an angle of 45 degrees is most desirable. All of the wings of each winged member set is attached parallel to each other and are spaced at equal intervals about the longitudinal axis of the sleeve member. Each wing is attached along its straight edge to the sleeve 3. As can be clearly visualized, it is apparent that when each wing member is attached along its straight edge to the arcuate surface of the cylindrical sleeve and at an angle relative to the longitudinal axis of the sleeve, the wing member will assume a concaved posture on one side and a convex posture on its opposite side. As intended in the instant invention, (See FIG. 2) the wings of each set are identically orientated on the surface of the cylindrical member as illustrated in FIG. 2. However, the wings of set 1 is orientated in opposite direction as the wings of set 2 (FIGS. 4 and 5) and each wing of each set is aligned midway between the distance between a pair of wings of the other set as illustrated in FIG. 3.

With the above arrangements, it can be seen that during the normal swing of a bat having the instant invention properly attached thereto, the hand grip of the bat will not be changed, but the bat will be rotated about its longitudinal axis and due to the above wing arrangement a constant wind resistance will be applied to the bat during the entire swinging motion.

It will thus be seen that the objects set forth above, and those made apparent from the foregoing description, and since certain changes may be made in the above construction without departing from the scope of the invention, it is intended that all matter contained in the foregoing description or shown in the accompanying drawings should be interpreted as illustrated and not in a limited sense.

What is claimed is:

1. A bat swing training apparatus comprising, an elongated cylindrical sleeve member having a length and inside diameter substantially equal to the respective length and outside diameter of the barrel or ball contact surface of a conventional baseball bat, one end of said cylindrical member having a conical tapered section for engaging the tapered portion of a bat between its handle and ball contact portion when said cylindrical member is properly placed on the bat, said cylindrical member having two sets of elongated wings attached and extending outwards from its outer surface, each set of wings being spaced longitudinally on said cylindrical member surface, the wings of each set being spaced about the longitudinal axis of said cylindrical member and each being an equal distance from a pair of adjacent wing, each of said wings of each set further being attach to said cylindrical member at a predetermined angle relative to said longitudinal axis whereby said angular attachment serve to cause each said wing to have a curved configuration along its length, the wings of one set being angularly oriented in an opposite direction relative to the orientation of said wings in the other set and each wing in said one set being aligned substantially midway the distance between a pair of wings in said other set.

2. The swing training apparatus as defined in claim 1 wherein, said angular orientation of said wings is substantially 45 degrees.

* * * * *